US007405702B2

(12) United States Patent
Annamaa et al.

(10) Patent No.: US 7,405,702 B2
(45) Date of Patent: Jul. 29, 2008

(54) ANTENNA ARRANGEMENT FOR CONNECTING AN EXTERNAL DEVICE TO A RADIO DEVICE

(75) Inventors: Petteri Annamaa, Oulunsalo (FI); Veli Torvinen, Kempele (FI)

(73) Assignee: Pulse Finland Oy, Kempele (FI)

( * ) Notice: Subject to any disclaimer, the term of this patent is extended or adjusted under 35 U.S.C. 154(b) by 261 days.

(21) Appl. No.: 11/330,714

(22) Filed: Jan. 11, 2006

(65) Prior Publication Data

US 2006/0176225 A1 Aug. 10, 2006

Related U.S. Application Data

(63) Continuation of application No. PCT/FI2004/00430, filed on Jul. 7, 2004.

(30) Foreign Application Priority Data

Jul. 24, 2003 (FI) ..... 20031101

(51) Int. Cl.
*H01Q 1/24* (2006.01)

(52) U.S. Cl. ..... 343/702; 455/575.2

(58) Field of Classification Search ..... 343/700 MS, 343/702, 829, 846, 906; 455/95, 575.2
See application file for complete search history.

(56) References Cited

U.S. PATENT DOCUMENTS 5,369,782 A * 11/1994 Kawano et al. ..... 455/16
5,532,703 A * 7/1996 Stephens et al. ..... 343/702
5,711,014 A * 1/1998 Crowley et al. ..... 455/575.7
6,134,421 A 10/2000 Lee et al.
6,157,819 A * 12/2000 Vuokko et al. ..... 455/575.7
6,556,812 B1 * 4/2003 Pennanen et al. ..... 343/702
2002/0154066 A1 10/2002 Bama et al.

FOREIGN PATENT DOCUMENTS

| | | |
|---|---|---|
| EP | 0 999 607 A2 | 5/2000 |
| EP | 1 006 605 A1 | 6/2000 |
| EP | 1 170 822 A1 | 1/2002 |
| EP | 1306922 | 5/2003 |
| GB | 2345196 | 6/2000 |

* cited by examiner

*Primary Examiner*—Tho G Phan
(74) *Attorney, Agent, or Firm*—Darby & Darby P.C.

(57) ABSTRACT

An arrangement by which an external device is connected to a radio device via its antenna without modifying the radio device mechanically. The radiating element (311) of the antenna of the radio device is a conductive part of its casing, which is fed electromagnetically by means of a feed element (322). The connecting is implemented by a coupler (310) to be placed at the antenna on top of the casing, from which coupler there is an intermediate cable (350) to the external device. The coupler includes a coupling element (311), from which there is electromagnetic coupling to the radiating element (321) through a thin dielectric membrane, or direct galvanic coupling. From the coupling element to the jumper cable there is electromagnetic coupling through an intermediate element (312), or direct galvanic coupling. Because the radiating plane is located on the outer surface of the radio device, its distance to the coupling element can be made very small. Thus the attenuation caused by the coupler on the transfer path from the antenna port of the radio device to the external device is lower than in the known arrangements.

10 Claims, 4 Drawing Sheets

ANTENNA ARRANGEMENT FOR CONNECTING AN EXTERNAL DEVICE TO A RADIO DEVICE

CROSS REFERENCE TO PRIOR APPLICATION

This application is a continuation of International Patent Application Serial No. PCT/FI2004/000430, filed Jul. 7, 2004, which claims priority of Finnish Application No. 20031101, filed Jul. 24, 2003, both of which are incorporated by reference herein. PCT/FI2004/000430 published in English on Feb. 3, 2005 as WO 2005/011053 A1.

The invention relates to an arrangement by which an external device is connected to a radio device via its antenna without modifying the radio device mechanically.

BACKGROUND OF THE INVENTION

In practice, the external device is most often an additional antenna that improves the quality of the radio connection, and the radio device is most often a mobile phone. An additional antenna may be needed in a vehicle, for example, when the field strength of a base station within the body of the vehicle is low. The additional antenna is then naturally outside the body, fastened to it. The vehicle can have a fixed holder for using an external antenna, and a phone placed in it is coupled to the external antenna by a coupling part and a cable. The external device can also be a measurement device or analyzer used in production or servicing. Naturally, such a device does not radiate electromagnetic energy, although the radio device "sees" it as a mere antenna.

For connecting an additional antenna, a mobile station can have a coaxial connector coupled to the antenna port. However, such a connector arrangement based on galvanic coupling is relatively expensive and unreliable in the course of time. Therefore, electromagnetic coupling can be used instead of galvanic coupling. FIG. 1 shows a known arrangement for coupling to the antenna of a radio device as two partial images. The partial image on the left shows the radio device RD as seen from the back and the other partial image shows it as a simplified longitudinal section. The antenna of the radio device is an internal antenna of the PIFA type (planar inverted F-antenna). The longitudinal sectional image thereof shows a ground plane GND, a radiating plane 121 and a short-circuit conductor 125. The radiating plane is relatively close to the back cover 105 of the radio device, and the ground plane is inner within the device. The arrangement includes a coupler 110 having approximately the spread of the internal antenna and being fastened with adhesive joint, for example, at the antenna on the outer surface of the back cover 105. The coupler includes a conductive strip-like coupling element 111, which has, for the above mentioned reason, relatively strong electromagnetic coupling with the radiating plane 121. Through this coupling, radio frequency energy is conveyed from the near field of the antenna outside the radio device and vice versa. A coaxial intermediate cable 150 runs from the coupling element to the additional antenna or other external device.

In this description and the claims, the short expression "coupler" means a device to be fastened to a radio device without modifying it mechanically, through which a radio frequency connection is arranged to an external device.

The applicant is aware of the method according to FIG. 2, described in patent application Ser. No. FI 20022117, for coupling to the internal antenna of a mobile phone, for example, for connecting an additional antenna. The coupling arrangement includes a coupler 210 placed on the back cover of the phone, having a first and a second coupling part. The first coupling part is intended to be placed at the internal planar antenna of the phone, and it has two interconnected coupling conductors 211 and 212, which are rigid conducting wires in this example. Of the phone, only the radiating plane 221 of the planar antenna is drawn in the main FIG. 2. The small side image also shows a part of the phone casing 205 between the radiating plane and the coupling conductor 211. In this example, the radiating plane is divided into a first and a second branch for increasing the number of operating bands. The feed and short-circuit points of the antenna are in an area in which the branches are interconnected. When the coupler has been put in its place, the coupling conductor 211 is located on top of the first branch as viewed from the direction of the normal to the radiating plane, and the coupling conductor 212 is correspondingly located on top of the second branch. In this way, the coupler is made to function both on the lower and upper band of the antenna.

The second coupling part of the coupler is intended to be located at the internal ground plane of the phone, and it consists of a conductive plate 213 with its side edges bent to form a right angle. These side edges press against the sides of the phone so that the coupler is fastened to the phone. There is a significant electromagnetic coupling between the conductive plate 213 and the ground plane. The coaxial intermediate cable 250 between the coupler and am external device is fastened to the conductive plate. The inner conductor of the intermediate cable is galvanically coupled to the interconnection point of the coupling conductors 211 and 212, and the outer conductor is galvanically coupled to the conductive plate close to the coupling point of the inner conductor. Through the coupling between the conductive plate and the ground plane, energy from the radio frequency field of the ground plane can also be transferred to the external device. The conductive plate 213 and the conducting wires 211, 212 function as a generator feeding the additional antenna, for example, through the intermediate cable 250.

SUMMARY OF THE INVENTION

In the arrangements according to FIGS. 1 and 2, there are at least the dielectric casing of the radio device and the dielectric protective layer of the coupling element between the coupling element of the coupler and the radiating plane of the antenna, in which case some attenuation is caused by the distance ensuing and dielectric losses. An object of the invention is to implement an arrangement for connecting an external device to the antenna of the radio device in a new and more advantageous manner. The arrangement according to the invention is characterized in what is set forth in the independent claim 1. Some preferred embodiments of the invention are set forth in the other claims.

The basic idea of the invention is the following: An external device is interfaced to the antenna of a radio device, the radiating element of the antenna being a conductive part of the casing of the radio device and being fed electromagnetically by means of a feed element. The interfacing is implemented by a coupler disposed at the location of the antenna on top of the casing. From the coupler leads a intermediate cable to the external device. The coupler includes a coupling element, from which there is electromagnetic coupling to the radiating element through a thin dielectric membrane or direct galvanic coupling. From the coupling element to the intermediate cable there is either electromagnetic coupling through an intermediate element or direct galvanic coupling.

The invention has an advantage that the attenuation caused by the coupler in the transfer path from the antenna port of the radio device to the external device is lower than the attenuation caused by known arrangements. This is due to that the radiating plane is located on the outer surface of the radio device, whereby its distance to the coupling element can be made very small. In addition, an advantage of the invention is that the coupler according to it is simple and reliable.

BRIEF DESCRIPTION OF THE DRAWINGS

In the following, the invention will be described in more detail. Reference will be made to the accompanying drawings, in which.

DETAILED DESCRIPTION OF THE INVENTION

Figure 1:
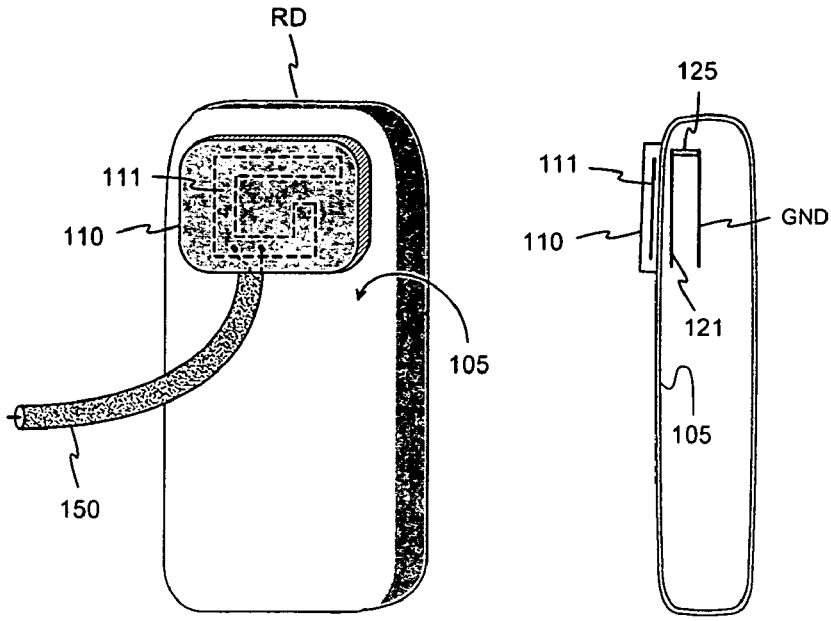
Fig. 1 PRIOR ART
FIG. 1 shows an example of a known arrangement for coupling to the antenna of a radio device.
Figure 2:
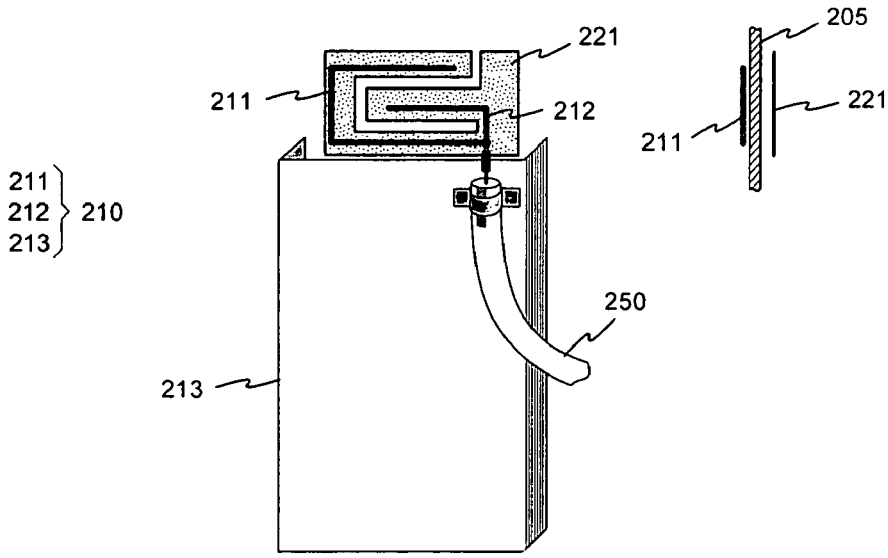
Fig. 2 PRIOR ART
FIG. 2 shows another example of a known arrangement for coupling to the antenna of a radio device.

FIGS. 1 and 2 were already discussed in connection with the description of the prior art.

Figure 3A:
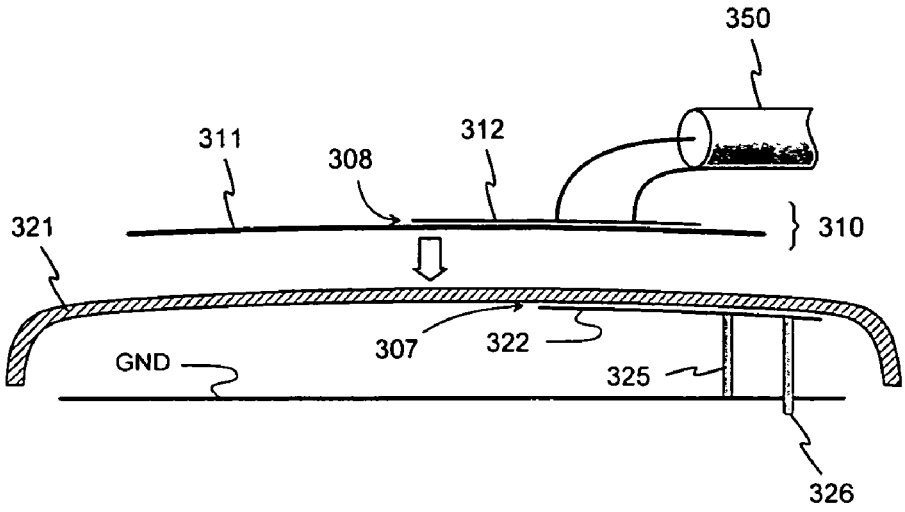
FIGS. 3*a-c* show an example of an arrangement according to the invention for connecting an external device to the radio device via the antenna.
Figure 3B:
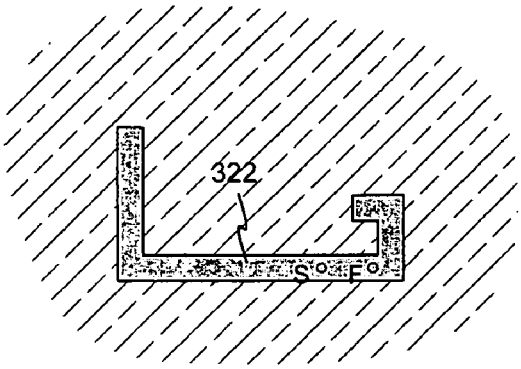
Figure 3C:
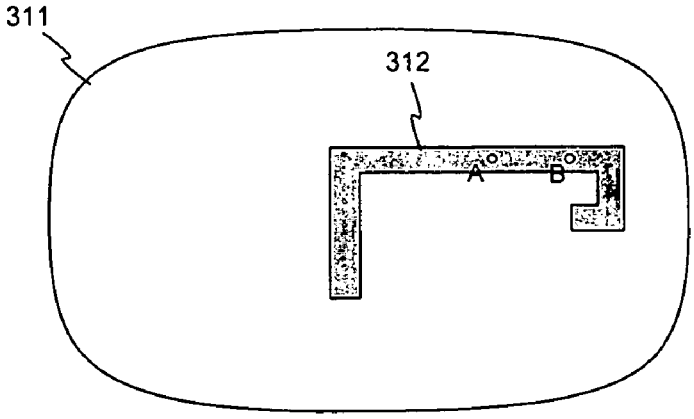

FIGS. 3*a-c* show an example of the antenna arrangement according to the invention for connecting an external device. In FIG. 3*a* shows a cross-section of the arrangement. It includes a radiating element 321 of a radio device, which can in this example be assumed to be a mobile phone, wherein the radiating element 321 is part of the conductive casing of the phone. Below the radiating element, or the radiator, there is the ground plane GND of the antenna. Between the radiator 321 and the ground plane, there is a conductive feed element 322, which is isolated from the radiator by a thin dielectric layer 307. The radiator has no galvanic coupling to any conductive part of the phone. The feed element 322 is galvanically coupled to the antenna port of the phone with a feed conductor 326 and to the ground plane with a short-circuit conductor 325. In FIG. 3*b* there is an example of the shape of the feed element 322. It is a conductor strip, which has two branches of different lengths as viewed from the short-circuit point S for forming two operating bands for the antenna. Together with the radiator and the ground plane, the longer branch resonates in the area of the lower operating band of the antenna, and together with the radiator and the ground plane, the shorter branch resonates in the range of the upper operating band of the antenna.

In FIG. 3*a* there also is seen a coupler 310 according to the invention, which in this example includes a coupling element 311, an intermediate element 312 and a thin dielectric layer 308 isolating these elements from each other. There is thus only electromagnetic coupling between the coupling element and the intermediate element. The two conductors of the intermediate cable 350 leading to an external device are galvanically coupled to the intermediate element 312. In FIG. 3*a* the coupler 310 is drawn as elevated from the radiator for the sake of clarity. During use, the coupling element 311 is located against the radiator 321. Between them there is e.g. only a thin dielectric protective layer, and thus the electromagnetic coupling between the elements is strong. Alternatively, the coupling element is galvanically against the radiator, in which case they form an electrically uniform conductive piece.

FIG. 3*c* shows an example of the shapes of the coupling element 311 and the intermediate element 312. The coupling element is a planar conductor with rounded corners having an area, which is e.g. half of the area of the radiator 311. The coupling element has such a thickness that it forms the load-bearing body of the coupler at the same time. The intermediate element 312 is a conductor strip to which the intermediate cable 350 is joined at certain points A and B. If the external device is an additional antenna, its performance on two bands can be improved by suitable dimensioning of the conducting strip 312 and suitable selection of the places for the points A and B. Such matching can naturally also be carried out when the whole apparatus has only one band.

As viewed from outside the device, the coupler 310 looks e.g. similar to the coupler 110 in FIG. 1.

Figure 4:
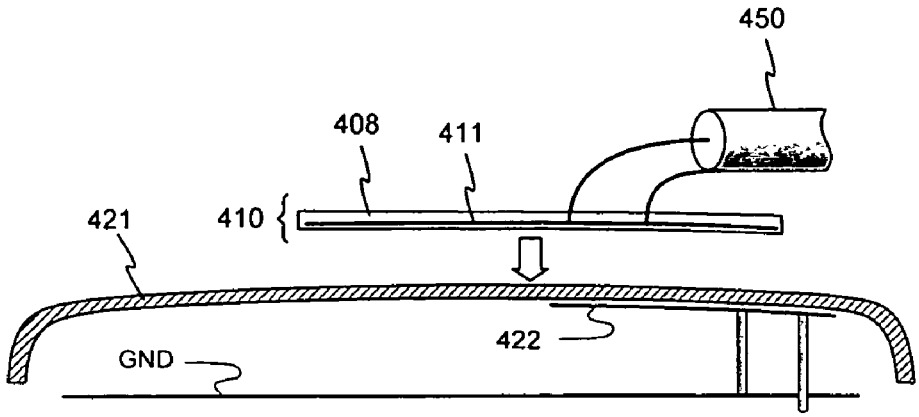
FIG. 4 shows another example of an arrangement according to the invention for connecting an external device to the radio device via the antenna.

FIG. 4 shows another example of the antenna arrangement according to the invention for connecting an external device. On the side of the radio device the arrangement is similar to that shown in FIG. 3*a*: It includes a radiating element 421, which is part of the conductive casing of the device, and a feed element 422 isolated from it. In this example, the coupler 410 comprises a coupling element 411 within a dielectric mass 408. The two conductors of the intermediate cable 450 leading to an external device are galvanically coupled directly to the coupling element 411. In FIG. 4, the coupler 410 is drawn as elevated from the radiator 421. During use, the coupling element 411 is against the radiator, isolated from it by a thin dielectric layer. Thus the electromagnetic coupling between these elements is relatively strong in this case as well. The coupling element 411 can be shaped similarly as the coupling element 311 in FIG. 3*c*.

Figure 5:
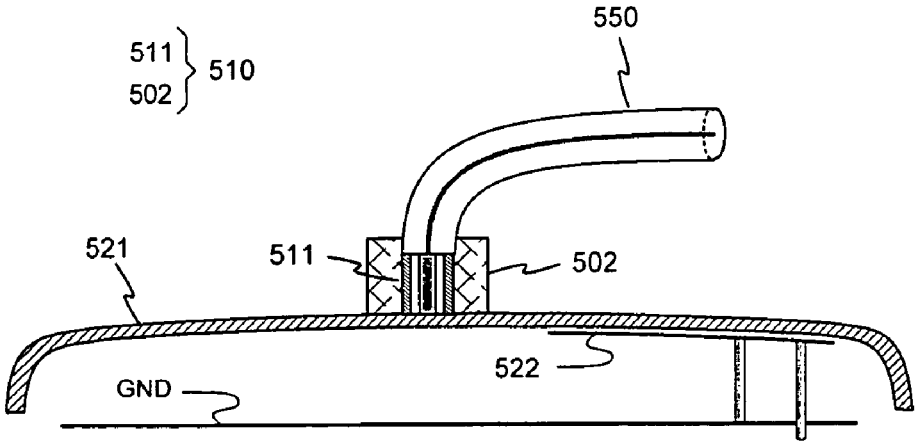
FIG. 5 shows a third example of an arrangement according to the invention for connecting an external device to the radio device via the antenna.

FIG. 5 shows a third example of the antenna arrangement according to the invention for connecting an external device. On the side of the radio device, the arrangement is similar to that shown in FIG. 3*a*: It includes a radiating element 521, which is part of the conductive casing of the device, and a feed element 522 isolated from it. In this example, the coupling element is a cylindrical extension of the coaxial intermediate cable 550. One end of the inner conductor of the coupling element 511 is permanently connected to the center conductor of the intermediate cable, and the other end has a galvanic contact to the radiator 521. The inner conductor can be telescopic type, so called pogo pin, in which case its internal helical spring improves the reliability of the contact. One end of the outer conductor of the coupling element 511, which has the shape of a cylindrical sheath, is permanently connected to the conductive sheath of the intermediate cable, and the other end has a galvanic contact to the radiator 521. The coupler 510 also includes a dielectric piece 502 for supporting the coupling element and the intermediate cable to each other and for detachably fastening the coupler to the radiator.

Figure 6:
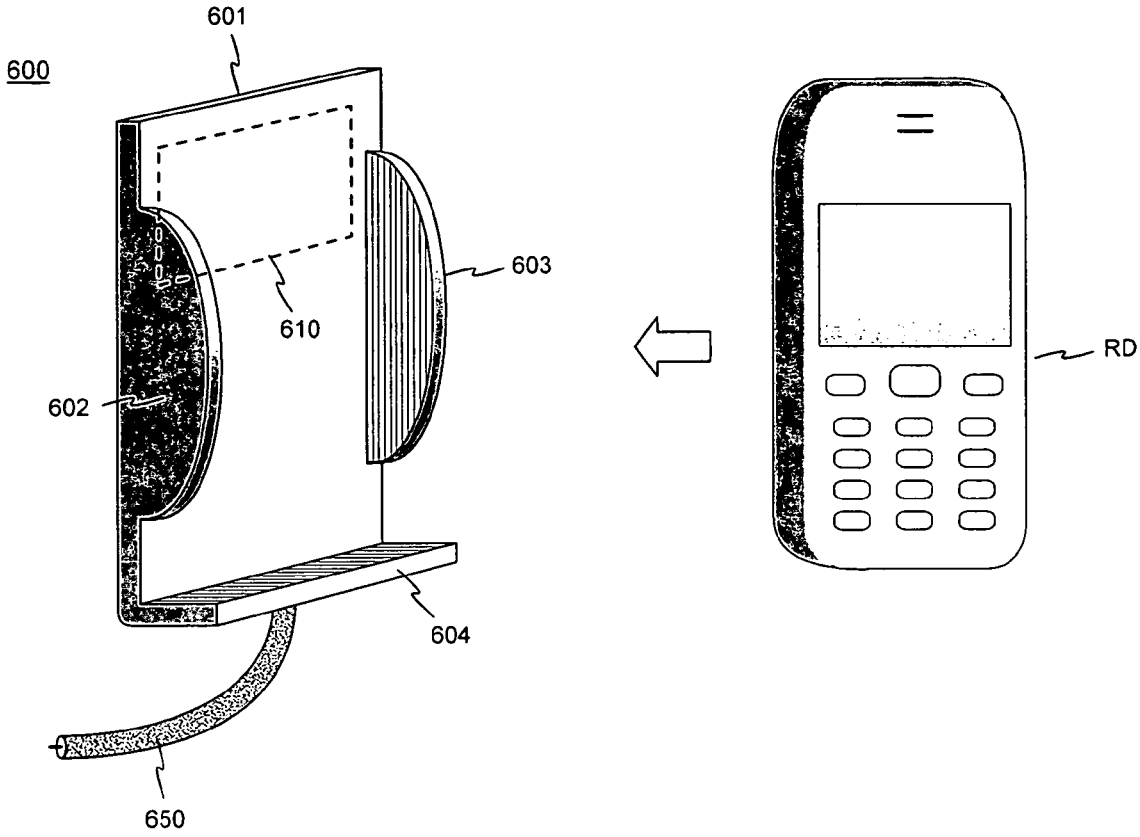
FIG. 6 shows an example of the appearance of the coupling device in practice.

FIG. 6 shows an example of the appearance of the coupling device in practice. The coupling device 600 has a back wall 601, lug-shaped side walls 602 and 603 and a bottom 604. The back wall contains the coupler 610 proper, with a intermediate cable 650 running from it. A radio device RD to be coupled is placed on the bottom 604 so that the antenna of the device is against the back wall 601 at the coupler 610. The side walls 602, 603 are slightly flexible and have such a distance from each other that the radio device is pressed between them with a suitable force. Thus the bottom and the side walls keep the radio device well in place.

Coupling arrangements according to the invention for connecting an external device to the radio device via its antenna have been described above. The phrase "the coupling element is placed against the radiating element" used in the description means also in the claims that the distance between said conductive elements is at least two orders smaller than the wavelength of the oscillation that occurs in the structure. The shapes and manners of implementation of the parts that belong to the arrangement can naturally differ from those described. Merely the mechanical and electrical adaptation to different radio devices causes variation in the elements of the device. The inventive idea can be applied in different ways within the scope defined by the independent claim 1.

The invention claimed is:

1. An arrangement for connecting an external device to a radio device via its antenna, the arrangement comprising a coupler to be placed on top of a casing of the radio device at the antenna and to be connected to the external device with a intermediate cable, the coupler comprising a coupling element for transferring radio frequency energy between the radio device and said intermediate cable, wherein a radiating element of the antenna is a conductive part of the casing of the radio device, in which case the coupling element is placed against the radiating element when the coupler is set in its place, and the radiating element has only electromagnetic coupling to other conductive parts of the radio device.

2. An arrangement according to claim 1, the coupling element and the radiating element being planar, and there is only a thin dielectric protective membrane between them when the coupler is set in its place, and thus a coupling between these elements is electromagnetic.

3. An arrangement according to claim 2, the coupling between the coupling element and said intermediate cable being galvanic.

4. An arrangement according to claim 3, wherein two conductors of the intermediate cable are connected to certain points of an element of the coupler to match the arrangement.

5. An arrangement according to claim 1, the coupling between the coupling element and the radiating element being galvanic when the coupler is set in its place.

6. An arrangement according to claim 5, the coupling element and the radiating element being planar, and said galvanic coupling being implemented substantially on the whole area of the coupling element.

7. An arrangement according to claim 5, the coupling element comprising an inner conductor with its first end permanently connected to a center conductor of the intermediate cable, and an outer conductor with its first end permanently connected to a conductive sheath of the intermediate cable, said galvanic coupling being made both by a contact between the second end of the inner conductor and the radiating element and by a contact between the second end of the outer conductor and the radiating element.

8. An arrangement according to claim 1, the coupler further comprising an intermediate element, which has electromagnetic coupling to the coupling element and galvanic coupling to said intermediate cable.

9. An arrangement according to claim 8, said intermediate element being a conductor strip.

10. An arrangement according to claim 8, wherein two conductors of the intermediate cable are connected to certain points of an element of the coupler to match the arrangement.

* * * * *